US005937837A

United States Patent [19]

Shaffer et al.

[11] Patent Number: 5,937,837

[45] Date of Patent: Aug. 17, 1999

[54] CRANKCASE BLOWBY DISPOSAL SYSTEM

[75] Inventors: Bradley J. Shaffer, Romney, Ind.; Richard P. Staab, Metamora, Ill.

[73] Assignee: Caterpillar Inc., Peoria, Ill.

[21] Appl. No.: 08/987,861

[22] Filed: Dec. 9, 1997

[51] Int. Cl.[6] ..... F02B 25/06

[52] U.S. Cl. ..... 123/573

[58] Field of Search ..... 123/572, 573, 123/574

[56] References Cited

U.S. PATENT DOCUMENTS

| | | |
|---|---|---|
| 2,450,864 | 10/1948 | Callaway et al. . |
| 2,652,819 | 9/1953 | Nusbaum . |
| 2,737,935 | 3/1956 | Olson . |
| 3,145,697 | 8/1964 | Barr et al. . |
| 3,225,753 | 12/1965 | Bintz . |
| 3,620,197 | 11/1971 | Barton et al. . |
| 3,659,625 | 5/1972 | Coiner et al. . |
| 3,662,723 | 5/1972 | Buhl . |
| 3,721,069 | 3/1973 | Walker . |
| 3,834,156 | 9/1974 | Cutler et al. . |
| 3,876,037 | 4/1975 | Rath, Jr. . |
| 3,882,967 | 5/1975 | Gulla et al. . |
| 3,978,671 | 9/1976 | Gonzalez . |
| 4,012,012 | 3/1977 | Ligler . |
| 4,091,894 | 5/1978 | Lang . |
| 4,091,895 | 5/1978 | Lang . |
| 4,092,962 | 6/1978 | Beaton et al. . |
| 4,105,092 | 8/1978 | Zeidler et al. . |
| 4,114,576 | 9/1978 | Goto et al. . |
| 4,157,744 | 6/1979 | Capriotti . |
| 4,167,164 | 9/1979 | Bachmann . |
| 4,184,858 | 1/1980 | Walker . |
| 4,256,064 | 3/1981 | Thorn . |
| 4,269,607 | 5/1981 | Walker . |
| 4,299,307 | 11/1981 | Scott . |
| 4,495,909 | 1/1985 | Hurner . |
| 4,557,226 | 12/1985 | Mayer et al. . |
| 4,632,080 | 12/1986 | Hurner . |
| 4,674,456 | 6/1987 | Merritt . |
| 4,724,807 | 2/1988 | Walker . |
| 4,724,926 | 2/1988 | Collins . |
| 4,741,304 | 5/1988 | Martin et al. . |
| 4,869,346 | 9/1989 | Nelson . |
| 4,962,745 | 10/1990 | Ohno et al. . |
| 5,090,393 | 2/1992 | Holch . |
| 5,092,429 | 3/1992 | Linares et al. . |
| 5,205,265 | 4/1993 | Kashiyama et al. . |
| 5,336,396 | 8/1994 | Shetley . |
| 5,347,973 | 9/1994 | Walker, Jr. . |
| 5,431,138 | 7/1995 | Hurner . |
| 5,456,239 | 10/1995 | Henderson et al. . |
| 5,479,907 | 1/1996 | Walker, Jr. . |
| 5,487,371 | 1/1996 | Beckman et al. . |

OTHER PUBLICATIONS

Mann Crankcase Breather Valve Mann + Hummel Ind. Dec. 7, 1989.

*Primary Examiner*—Marguerite McMahon
*Attorney, Agent, or Firm*—Alan J. Hickman; Fred J. Baehr

[57] ABSTRACT

A crankcase blowby disposal system for a reciprocating engine comprising a heat exchanger in fluid communication with an oil filter and the crankcase in which blowby comprising oil droplets, oil mist, oil vapor, water vapor and other gases, the blowby is vented from the crankcase, passes through the heat exchanger which cools the blowby to a temperature below the dew point of the oil vapor and above the dew point of the water vapor, whereby the oil vapor condenses and the water vapor does not condense, then the cooled blowby passes through an oil filter which removes essentially all the oil from the blowby, the oil free blowby is then returned to the engine intake or exhaust or vented to the atmosphere, the oil collected in the oil filter may be returned to the crankcase.

11 Claims, 1 Drawing Sheet

CRANKCASE BLOWBY DISPOSAL SYSTEM

TECHNICAL FIELD

The invention relates to a crankcase blowby disposal system and more particularly to a system for removing oil from crankcase blowby before the blowby is returned to the engine or is discharged to the atmosphere.

BACKGROUND ART

Reciprocating engines such as internal combustion engines and compressors force small amounts of the gaseous media they compress past seal rings and into the crankcase. The gaseous media, which passes through the seal rings is normally referred to as blowby and collects in the crankcase partially filled with lubricating oil. The lubricating oil is highly agitated by the crankshaft and connecting rods forming small oil droplets and mist, which become entrained in the gases in the crankcase. The crankcase is normally hot causing some of the oil to vaporize. To avoid a build up of pressure in the crankcase, the blowby is exhausted from the crankcase to the atmosphere. In internal combustion engines the blowby can be returned to the engine intake or to the exhaust.

The presence of lubricating oil in the blowby from reciprocating machines is environmentally undesirable and difficult to remove, since it is normally in the form of droplets, submicron mist and vapor. In internal combustion engines lubricating oil in the blowby is also accompanied by environmentally harmful products of combustion. To mitigate the affect of the harmful elements in the blowby, the blowby is readmitted to the normal flow of air and fuel to the engine or to the hot exhaust gasses to provide more complete oxidation of the elements in the blowby. The blowby from reciprocating compressors can not be returned to the compressor inlet as the presence of lubricating oil in the compressed gases is normally undesirable.

Filters only remove particulate material, liquid droplets, liquid mist, and submicron sized droplets; but, allow oil vapor to pass through. Water vapor is also found in the typical blowby from reciprocating engines and normally in large quantities relative to oil vapor. If the water vapor condenses to liquid it will saturate the oil filter media and block the flow. The collected water may also freeze in cold weather.

U.S. Pat. No. 5,456,239 shows a crankcase ventilation system for an internal combustion engine having a supercharger and an after cooler in which the crankcase blowby is returned to the engine inlet manifold by an accumulator having a diaphragm pump operated by switching the pressure on one side of the diaphragm from the pressure at the inlet of the supercharger to the pressure at the exit of the supercharger to pump the crankcase blowby into the inlet manifold.

DISCLOSURE OF THE INVENTION

Among the objects of the invention may be noted the provision of a crankcase blowby disposal system which will remove essentially all of the lubricating oil, including oil vapor, without condensing the water vapor in the crankcase blowby.

In general, a crankcase blowby disposal system for a reciprocating engine, when made in accordance with this invention, comprises an after cooler disposed up stream of an inlet gas manifold to provide a predetermined after cooler exit gas temperature. A heat exchanger is disposed in fluid communication with the crankcase so as to cool the crankcase gases that pass there through. An oil filter is disposed down stream of the heat exchanger for removing oil mist and droplets from the crankcase blowby. The heat exchanger is designed so that the crankcase blowby is cooled to a temperature that will condense the oil vapor, but not the water vapor. Whereby the condensed oil vapor is now in the form of oil mist and droplets that can be removed by the oil filter, while water vapor passes through the oil filter. The crankcase blowby is now essentially oil free and can then be discharged to the atmosphere or returned to the engine.

BRIEF DESCRIPTION OF THE DRAWINGS

The invention as set forth in the claims will become more apparent by reading the following detailed description in conjunction with the accompanying drawings, wherein like reference numerals refer to like parts throughout the drawings and in which:

BEST MODE FOR CARRYING OUT THE INVENTION

Figure 1:
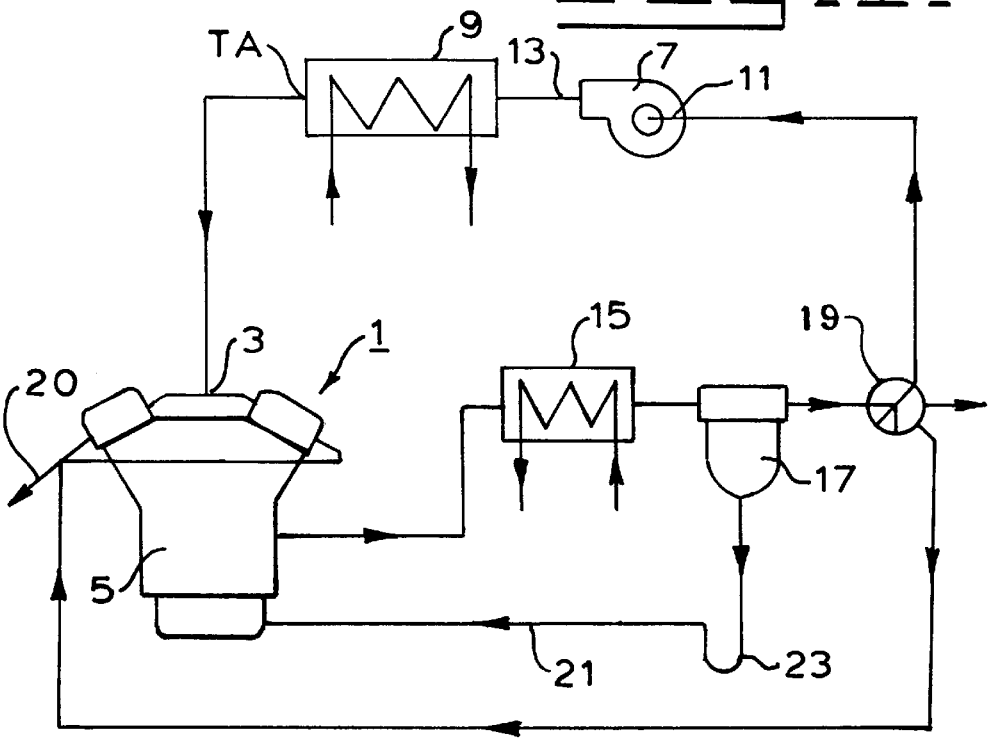
FIG. 1 is a schematic view of an internal combustion engine incorporating this invention.

Referring now to the drawings in detail and in particular to FIG. 1, there is shown a reciprocating internal combustion engine 1 comprising an intake manifold 3 and a crankcase 5. A supercharger or turbocharger 7 and an after cooler 9 are disposed in fluid communication with the intake manifold 3, upstream thereof. The supercharger 7 has an intake portion 11 in fluid communication with the atmosphere and a discharge portion 13 in fluid communication with the after cooler 9. The after cooler 9 perferably has an extended heat transfer surface on the air or gas side, if a liquid coolant is utilized. The after cooler 9 is designed so that exit temperature of the air is set at some predetermined temperature TA, generally about 32° C. A heat exchanger 15 is disposed in fluid communication with the crankcase 5 and an oil filter 17. A three way valve 19 places the oil filter 17 in fluid communication with the intake portion 11 of the supercharger 7, with an exhaust manifold 20 or with the atmosphere. Showing schematically that the blowby with essentially all of the oil removed can be returned to the engine intake or exhaust or to the atmosphere. As the engine 1 operates, pressure build up in the cylinders (not shown) causes gasses which include products of combustion to bypass the piston rings (not shown) and enter the crankcase 5 increasing the pressure so that it becomes necessary to vent the crankcase. The crankshaft and connecting (rods not shown) agitate lubricating oil disposed in the crankcase forming oil droplets and oil mist. The crankcase 5 is also heated up during operation, causing some of the lubricating oil to vaporize. Thus the blowby that must be vented contains products of combustion which comprises water vapor, other gases and lubricating oil as droplets, mist and vapor. The oil filter 17 can only remove particulate material, droplets and mist. The oil filter 17 can not remove gases or vapor from the blowby. The amount of water vapor is vary large relative to the amount of oil vapor, oil mist and oil droplets, therefore, if the water is condensed it would over load the oil filter 17, plugging it up with a thick jelly like, oil water emulsion. If ambient temperature is below freezing, the water in the filter 17 and associated lines will freeze.

Psychrometric charts showing the dew point of water vapor in air at a particular relative humidity are common, however there are no psychrometric charts that show the dew point of oil vapor relative to the amount of oil vapor in gaseous solution with air. it was determined that if the crankcase blowby is cooled to a temperature equal to or slightly below the temperature at the outlet of the after cooler, oil vapor will condense, but water vapor will not condense. Thus, the water vapor will pass through the oil filter 17, while the oil vapor has condensed to a mist, which is submicron in size, but can be removed by the oil filter 17. Some of the oil mist may coalesce on the heat exchanger 15 surfaces and be blown off as oil droplets.

Oil collected in the oil filter 17 may be returned to the crankcase 5 via a oil return conduit 21, which has a trap 23 (shown schematically) disposed to only allow oil to be returned from the oil filter 17. The oil from the oil filter 17 may also be returned to some other container.

Figure 2:
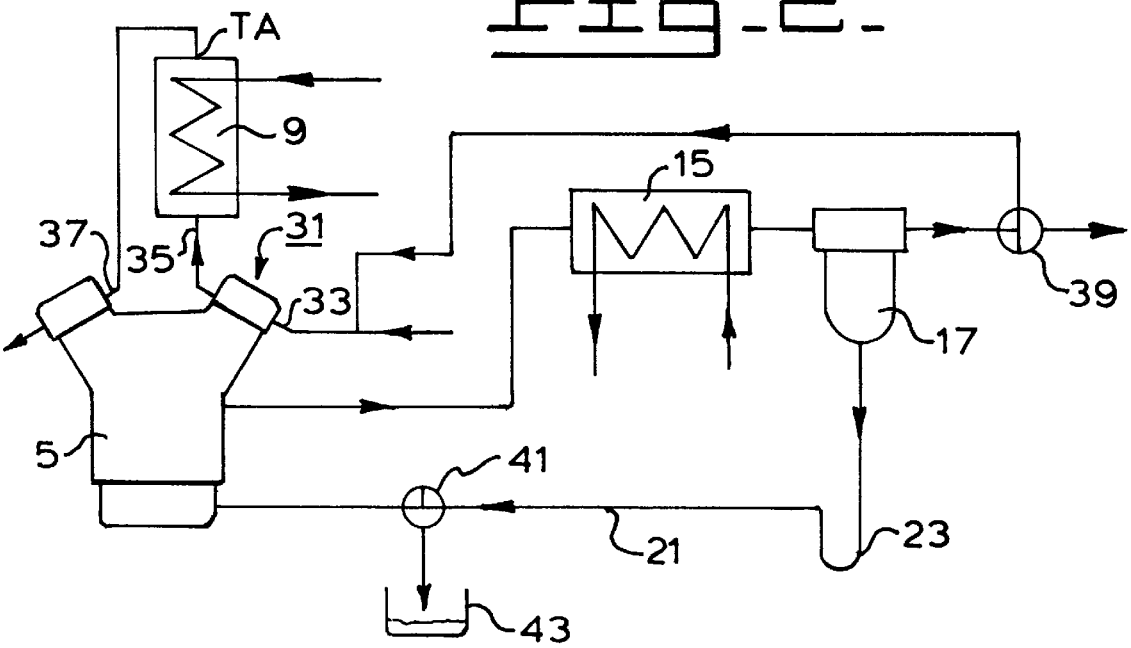
FIG. 2 is a schematic view of a reciprocating compressor engine incorporating this invention.

FIG. 2 shows a reciprocating two stage engine 31 for compressing air or some other combination of gases that enter a first stage inlet manifold 33 and is drawn into the first stage cylinders (not shown). The gases are compressed and then pass through a conduit 35 and into the after cooler 9. After passing through the after cooler 9 and a second stage inlet manifold 37 the compressed gases are compressed to a higher pressure in the second stage of the compressor 31. Blowby gases leak through piston seal rings pressurizing the crankcase 5. Blowby comprises compressed gases, lubricating oil droplets, mist and vapor, and water vapor as the crankcase is heated and the oil is agitated by the crank shaft and piston rods (not shown) just like in an internal combustion the only thing missing is products of combustion. Blowby vented from the crankcase passes through a heat exchanger 15, wherein the temperature of the blowby is reduced generally to the temperature of the gases leaving the after cooler 9 or to some other preselected temperature. The oil vapor in the cooled blowby will condense to an oil mist, but water vapor will not be condensed. The blowby is then passed through the oil filter 17, which removes the oil mist and oil droplets and allows the water vapor to pass through the oil filter 17. Normally the blowby would be dumped to the atmosphere, if the reciprocating engine 31 were an air compressor. However, if the compressor were utilized to compress some process gases, the blowby would require special handling. As essentially all of the oil has been removed by the combination of the heat exchanger 15 and oil filter 17, the oil free blowby can be returned to the reciprocating compressor engine 31. A two way valve 39 schematically shows either mode of operation.

Oil collected in the oil filter 17 is returned to the crankcase 5 via a oil return conduit 21 having a trap 23 (shown schematically) disposed to only allow oil to be returned from the oil filter 17 or the oil from the oil filter may alternatively be diverted by a two way valve 41 to some other type of container 43.

While the preferred embodiments, described herein, set forth the best mode to practice the invention presently contemplated by the inventors, numerous modifications and adaptations of this invention will be apparent to others of ordinary skill in the art. Therefore, the embodiments are to be considered as illustrative and exemplary and it is understood that the claims are intended to cover such modifications and adaptations as they are considered to be within the spirit and scope of this invention.

INDUSTRIAL APPLICABILITY

The crankcase blowby disposal system, herein before described, advantageously cools the blowby to a preselected temperature equal to or slightly lower than the lowest temperature experienced in the engine prior to entering the oil filter eliminating the possibility of condensing liquid oil on engine surfaces. Operating the blowby system between the dew point of oil vapor and the dew point of water leads to the optimum filtration of oil from the blowby as essentially all of the oil vapor is condensed to mist or droplets which can be removed by the oil filter 15. Water vapor on the other hand is not condensed preventing the oil filter from being overwhelmed with water as the quantity of water in the products of combustion in the blowby is orders of magnitude greater. Cooling to a temperature below the dew point of water would lead to the system plugging with a thick jelly like emulsion of oil and water. And if the ambient temperature goes below freezing the water in the filter will freeze causing blockage.

What is claimed is:

1. A crankcase blowby disposal system for removing oil from crankcase blowby which comprises water vapor, oil vapor, oil mist, oil droplets and other gases, collecting in a crankcase of a reciprocating engine having an after cooler disposed up stream of an inlet gas manifold which provides an after cooler exit gas temperature, the system comprising a heat exchanger disposed in fluid communication with the crankcase so as to cool the crankcase blowby that pass there through, an oil filter disposed down stream of the heat exchanger for removing oil mist and droplets from the crankcase blowby, the heat exchanger being designed so that the crankcase blowby is cooled to a temperature equal to the after cooler exit gas temperature which will condense the oil vapor and will not condense the water vapor, whereby the condensed oil vapor is now in the form of oil mist and droplets that will be removed by the oil filter, while the water vapor passes through the oil filter.

2. The crankcase blowby disposal system as set forth in claim 1, wherein the heat exchanger is designed to cool the blowby to a temperature slightly lower than the after cooler exit temperature, whereby only oil vapor will be condensed and water vapor will not be condensed in the heat exchanger.

3. The crankcase blowby disposal system as set forth in claim 1 further comprising a conduit and a trap disposed between the oil filter and the crankcase, the trap only allowing the liquid oil collected in the oil filter to flow back to the crankcase.

4. The crankcase blowby disposal system as set forth in claim 1, wherein the engine has a supercharger disposed up stream of the after cooler and the oil filter is in fluid communication with an inlet portion of the supercharger returning the oil free blowby to the engine.

5. The crankcase blowby disposal system as set forth in claim 1, wherein the crankcase blowby is discharged to the atmosphere after it passes through the oil filter.

6. The crankcase blowby disposal system as set forth in claim 2 further comprising a conduit and a trap disposed between the oil filter and the crankcase, the trap only allowing liquid oil collected in the oil filter to flow back to the crankcase.

7. The crankcase blowby disposal system as set forth in claim 2, wherein the engine has a supercharger disposed up stream of the after cooler and the oil filter is in fluid communication with an inlet portion of the supercharger returning the oil free blowby to the engine.

8. The crankcase blowby disposal system as set forth in claim 2, wherein the crankcase blowby is discharged to the atmosphere after it passes through the oil filter.

9. A method of removing oil from crankcase blowby which comprises water vapor, oil vapor, oil mist, oil droplets and other gases from an engine having an after cooler disposed upstream of an inlet gas manifold providing an after cooler exit gas temperature, the method comprising the steps of passing crankcase blowby through a heat exchanger to cool the crankcase blowby to a temperature equal to the after cooler exit gas temperature which will condense the oil vapor and will not condense the water vapor, and then passing the cooled crankcase blowby through an oil filter which will remove oil mist and droplets and not water vapor from the blowby.

10. The method of removing oil from crankcase blowby as set forth in claim 9, further comprising the step of returning oil collected by the filter to the crankcase.

11. A method of removing oil from crankcase blowby as set forth in claim 9, wherein the crankcase blowby passed through the heat exchanger is cooled generally to a temperature slightly lower than the temperature at an outlet of the after cooler.

* * * * *